US005293654A

United States Patent [19]

Castwall et al.

[11] Patent Number: 5,293,654

[45] Date of Patent: Mar. 15, 1994

[54] ENERGY AND WATER SAVING SHOWER ASSEMBLY

[75] Inventors: Lennart W. Castwall, Täby; Karl F. Andersson, Åkersberga, both of Sweden

[73] Assignee: Aktiebolaget Electrolux, Sweden

[21] Appl. No.: 966,804

[22] Filed: Oct. 26, 1992

[30] Foreign Application Priority Data

Nov. 22, 1991 [SE] Sweden ..... 9103463-7

[51] Int. Cl.[5] ..... A47K 3/08

[52] U.S. Cl. ..... 4/598; 4/602; 4/603

[58] Field of Search ..... 4/596, 597, 598, 602, 4/603, 665

[56] References Cited

U.S. PATENT DOCUMENTS

| | | | |
|---|---|---|---|
| 4,432,103 | 2/1984 | Hunziker | 4/597 |
| 4,828,709 | 5/1989 | Houser et al. | 4/603 |
| 4,893,364 | 1/1990 | Keeler | 4/597 |

FOREIGN PATENT DOCUMENTS

| | | | |
|---|---|---|---|
| 3436941 | 4/1986 | Fed. Rep. of Germany | 4/596 |
| 3915008 | 11/1990 | Fed. Rep. of Germany | 4/597 |
| 1071023 | 4/1986 | Japan | 4/602 |
| 1602191 | 11/1981 | United Kingdom | 4/602 |

*Primary Examiner*—Henry J. Recla
*Assistant Examiner*—Charles R. Eloshway
*Attorney, Agent, or Firm*—Pearne, Gordon, McCoy & Granger

[57] ABSTRACT

A shower assembly is disclosed having a spray nozzle (41) through which liquid flows into a shower cabinet (10). The shower has a collecting container (22) for the liquid, the nozzle and container being integrated with a circulation system including a pump (33) with which the liquid in the collecting container can be circulated through the nozzle (41). The shower also has a mechanism (18, 20) by which the liquid either can be directed to the container (22) or directly to a sewage (21).

17 Claims, 1 Drawing Sheet

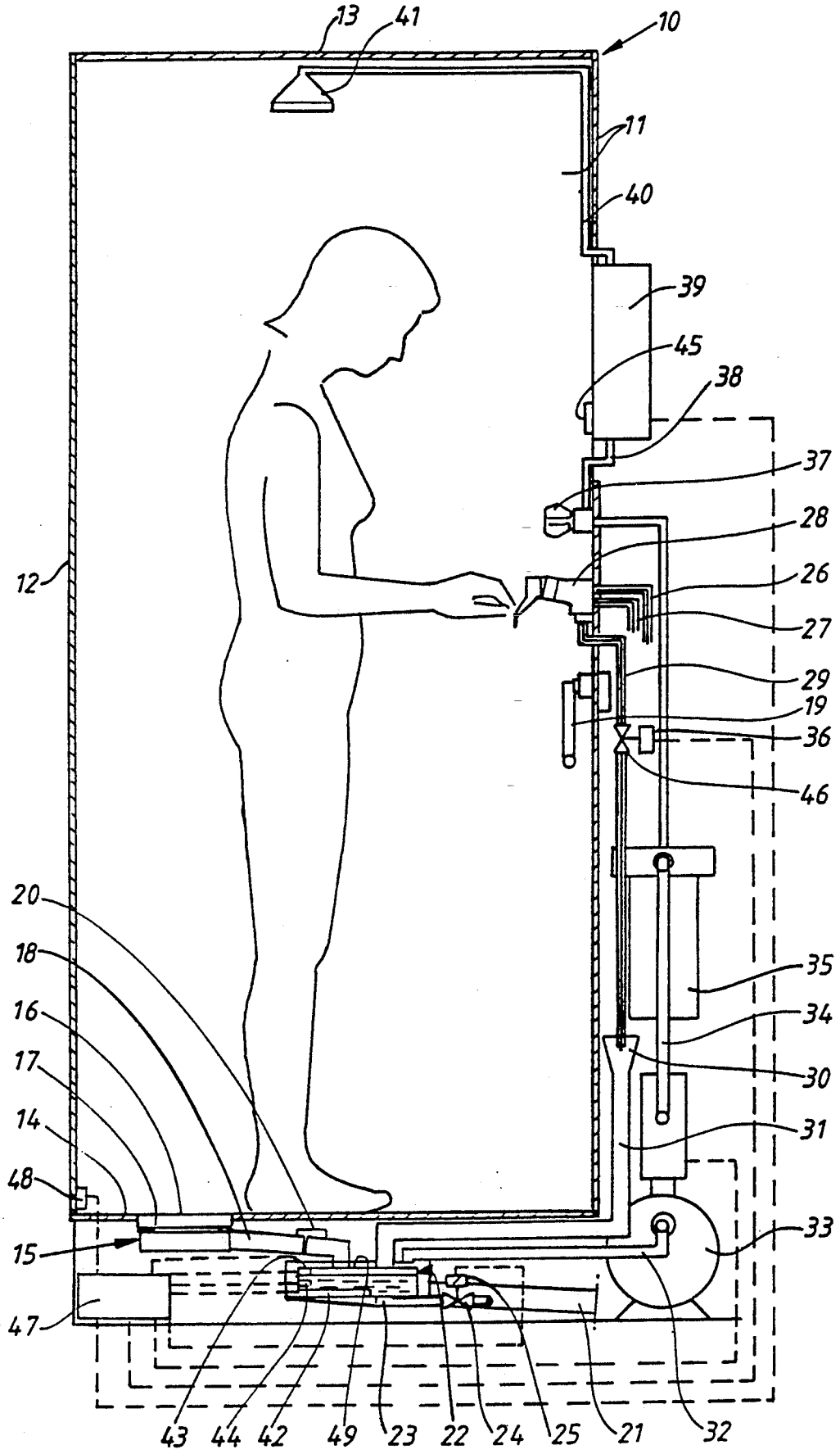
13
41
10
11
40
39
45
38
37
28
26
27
29
19
36
46
12
20
18
16
17
14
48
15
47
35
34
30
31
33
43
44
42
49
23
22
24
25
21
32

ENERGY AND WATER SAVING SHOWER ASSEMBLY

BACKGROUND OF THE INVENTION

I. Field of the Invention

This invention relates to shower assemblies, and specifically to a shower having a spray nozzle through which liquid flows and a collecting container for the liquid, the nozzle and container being a part of a circulation system including a pump by means of which the liquid in the collecting container is circulated through said nozzle.

2. Description of the Related Art

Compared to bath tubs, the use of conventional shower assemblies results in a considerable saving of energy and water which has contributed to the popularity of showering. In spite of this, the energy and water consumption still is high.

Recently, shower cabinets have been marketed which are simple to install, do not need a special insulation for wet room areas, and have the advantage that the cleaning procedure is limited to a restricted area which is comparatively easy to clean. These shower cabinets are open at their upper part which means that moisture, together with a large amount of heat, escapes to the surrounding area during the shower.

In order to save energy and water during the shower, it has been suggested to use flow reducing means such as water saving nozzles and impulse shower assemblies. However, even when using these types of showers, a large amount of energy and water disappears directly to the sewage system.

It has moreover been suggested to use shower assemblies which have a circulation system for water, see for instance SE 8106668-0 and corresponding U.K. Patent No. 1,602,191 and DE 3436941. SE 8106668-0 describes a shower assembly having a circulation system in which the water is stored in two containers. The water in one of the containers is used during an initial soap or cleaning procedure whereas the water in the other container is used during the rinse procedure. The disadvantage with this system is that, in addition to the water handling problem when filling the containers, only dirty water is circulated since the clean rinsing water during the shower is transferred to and mixed with the cleaning water. This in turn means that the rinsing procedure only can be carried through as long as there is water in the container being used for that purpose.

DE 3436941 describes a system which is used for a rinsing procedure after a sauna bath, the water being filled into a container and then being circulated through nozzles. This system cannot, however, be used during a combined cleaning and rinsing procedure since the dirty water which is a result of the cleaning procedure would also circulate during the rinsing procedure. In order to carry through a rinsing procedure with clean water, it is necessary to empty the container and then take in new water.

SUMMARY OF THE INVENTION

The purpose of this invention is to create a new type of shower assembly in which the water and energy consumption are considerably reduced compared to conventional shower assemblies, while the shower assembly makes it possible to carry through a shower procedure with a cleaning and rinsing phase where the rinsing phase uses circulating clean water. The moisture which leaves the shower assembly to the surrounding area is also limited. This is achieved with a shower assembly having the characteristics mentioned in the claims.

BRIEF DESCRIPTION OF THE DRAWING

An embodiment of the invention will now be described with reference to the attached drawing which diagrammatically shows an elevational view in section through a device according to the invention.

DETAILED DESCRIPTION OF THE PREFERRED EMBODIMENT

As appears from the figure, the shower assembly comprises a closed space shaped as a cabinet 10 with surrounding walls 11, a door 12, a roof 13 and a floor 14 the floor sloping towards a floor drain 15.

The floor drain 15 has a grating 16 in which a filter 17, preferably a disposable filter of paper or plastic, is placed, this filter being easily exchangeable. The floor drain 15 also has an outlet pipe 18 which can be connected to a sewage 21 or a collecting container 22 by means of an operating arm 19 in the cabinet which, via an operating mechanism 20 such as a two-way valve, is electrically connected to the arm. It is also possible to use other means in order to direct the outlet flow from the floor drain to the collecting container and sewage, respectively, for instance, a bowden cable connecting the operating mechanism 19 with a movable outlet part of the floor drain so that it can be moved between a position above the container and a position above the sewage. The container 22 has an outlet 23 communicating with the sewage 21 the outlet 23 being provided with a bottom valve 24 which is operated manually or by electrical means 25.

The shower assembly is provided with inlet pipes 26 and 27 for warm and cold water, respectively, these pipes being connected to a water-mixer 28 having an outlet pipe 29 which, via an air gap 30, continues into an inlet pipe 31 to the collecting container 22.

At the bottom of the collecting container 22 there is an outlet to a suction pipe 32 which communicates with a pump 33 the pressure side of which, via a pipe 34, is connected to a filter 35 containing active carbon. This filter might be placed at another position, for instance, at the inlet pipe 31 where the risk for clogging of the filter usually is less than in the circulation circuit. From the carbon filter 35, a pipe 36 extends to a valve 37 which is accessible from the inside of the shower cabinet, the valve, via a pipe 38, being connected to a UV-filter 39. This UV-filter is a cleaning device containing a lamp emitting ultraviolet light of a certain wavelength adapted to kill bacteria in the water. From the UV-filter, a pipe 40 continues to one or several shower nozzles 41 arranged at the upper part of the cabinet 10. One of the shower nozzles is preferably of the water-saving type and is shaped as a hands-free shower. The operator, by means of a control device, not shown, has the ability to choose between letting the water flow through this nozzle or other conventional nozzles. In the container 22, there is a heat creating device, for instance a heating coil 42, by means of which the water in the container can be heated. Further, there is a level sensor 43 and a temperature sensor 44 in the collecting container 22 or at another suitable place, a temperature controlling device 45 in the shower cabinet and a valve 46 in the outlet pipe 29, each of these devices 43, 44, 45 and 46, being connected to an electric control unit 47 via electrical wires. To this control unit 47 are also connected the heating coil 42, the bulb of the UV-filter 39, the pump 33, the bottom valve 24, the operating mechanism 20 and a door switch 48. The collecting container 22 also has an overflow 49 directing excess water into the sewage 21.

The device operates in the following way. When the door 12 is closed by the person who is going to take a shower, the door switch 48 activates the lamp of the UV-filter 39 and the bottom valve 24 so that it closes. When the water-mixer 28 is activated, cold and warm water is taken from the pipes 26 and 27—in the proportions the mixer is preset for—into the outlet 29. The water then flows via the air gap 30, which in the usual way prevents water from being sucked backwards into the pipe system, and the inlet pipe 31 into the collecting container 22. When the level has reached a predetermined level, the level sensor 43 activates the pump 33 and the valve 46 so that it closes and the supply of water to the container 22 ceases. This means that the water in the container 22 flows through the suction pipe 32, the pipe 34 and then into the filter 35 which contains active carbon. In the filter, the water is cleaned since badly smelling substances, for instance chlorine, are partly or completely removed. The water then flows through the pipe 36 and the valve 37 into the UV-filter 39 where the water is further cleaned of bacteria, if any, before the water, via the pipe 40, is transferred to one or several shower nozzles 41.

The operator can, by acting on the operating arm 19, choose one of two alternatives. Either it is possible, during an initial soap treating phase, to choose the water saving nozzle with the above mentioned control means and direct the dirty water directly to the sewage without entering the container 22 or it is possible, during the rinsing phase, to circulate the water in the shower assembly, via the container 22, preferably through the usual nozzles, i.e. without limitation of the flow.

In case the operator has determined to use the soap alternative, the operating mechanism 20 is activated and directs the water from the floor drain 15 via the outlet pipe 18 directly to the sewage 21. When the water flows through the disposal filter 17 in the floor drain, larger particles and hair remnants are separated out. During this phase the liquid level in the container 22 gradually sinks which means that the level sensor 43 opens the valve 46 so that new water is supplied to the container 22.

When the operator has decided to enter into a rinsing phase, the operating arm 19 is moved to the other position. This means that the operating mechanism 20 moves the outlet pipe 18 to a position in which the water flows out from this pipe and is returned into the container 22. Excess water, if any, leaves directly to the sewage 21 via the overflow 49 and additional water as necessary, is supplied in a way described above by influence of the level sensor 43. The water will now circulate through the carbon filter 35 and the UV-filter 39 and hence achieve a gradually increased degree of cleaning. In order to keep a comfortable water temperature during the shower procedure the temperature is set by means of the temperature control device 45. The temperature of the water is sensed by means of the temperature sensor 44 and compared to the preset value. If the water temperature is too low the heating coil 42 is activated until a suitable temperature has again been reached. Since the container is comparatively small, in the magnitude of a few liters, heating is effected very quickly with moderate power. The temperature sensor also cuts off the water supply if the temperature for some reason should rise above a critical value, for instance where there is a risk of injuries. It is of course also possible instead of adding heat by activating the heating coil to use a system in which hot water is taken in directly from the supply pipe 26 and mixed into the circulation system, the excess water leaving via the overflow. It should also be mentioned that it is possible to desist from the use of a level sensor 43 and the valve 46 and instead leave it to the operator to control the supply of water to the container.

When the shower procedure has been finished and the door is opened, the door switch 48 is deactivated which means that the bottom valve 24 is opened the container 22 being emptied of water and the lamp of the UV-filter goes out.

By said recovering of shower water during the rinsing phase it is possible to save very large quantities of heat and water. Since the shower cabinet is completely closed, the main part of the heat content is recovered as condensate. Also the moisture problem which an open shower cabinet structure can cause is eliminated.

With the exception of saved water and energy, which is of great importance in such areas where there is water and/or energy shortage, the device according to the invention also has the advantage that a high degree of cleaning of the water is achieved. Thus the shower can be used in such areas where the water quality is rather poor without this being a risk for the user of the shower. The cleaning also means that people usually having problems with rash or skin irritations when taking a shower in normal water have a greater chance to avoid them.

The shower cabinet according to the invention is preferably integrated with the said equipment to one unit which in a simple way can be transported and connected to existing electric installations and water installations.

What is claimed is:

1. A shower assembly comprising at least one spray nozzle through which liquid flows and a collecting container for the liquid, a circulation system integrated with the nozzle and container and comprising a pump adapted for circulating the liquid in the collecting container through said nozzle, characterized in that the shower assembly has means for selectively directing the liquid to said container or to a sewage.

2. A shower assembly according to claim 1, further comprising a floor drain to which said liquid directing means are connected.

3. A shower assembly according to claim 2, wherein the floor drain is covered by a mechanical filter.

4. A shower assembly according to claim 1, further comprising a bottom valve for connecting the collecting container to the sewage.

5. A shower assembly according to claim 1, further comprising supply pipes for water to the shower connected to a supply pipe ending in the collecting container.

6. A shower assembly according to claim 1, wherein the circulation system is provided with means for cleaning the liquid.

7. A shower assembly according to claim 6, wherein said cleaning means is a UV-filter.

8. A shower assembly according to claim 7, further comprising means for opening the bottom valve when the shower procedure has been finished and closing the bottom valve.

9. A shower assembly according to claim 8, wherein said bottom valve opening and closing means activates the UV-filter before the shower is started.

10. A shower assembly according to claim 6, wherein the liquid cleaning means is connected to an inlet pipe (31).

11. A shower assembly according to claim 6, wherein a shower is connected to supply pipes (26,27).

12. A shower assembly according to claim 6, wherein a shower is connected to the collecting container (22).

13. A shower assembly according to claim 6, wherein said cleaning means is an active carbon filter (35).

14. A shower assembly according to claim 1, further comprising walls shaped as a completely closed cabinet.

15. A shower assembly according to claim 1, wherein the circulation system is provided with a temperature controlling device which controls supply of cold and warm water.

16. A shower assembly according to claim 1, wherein the collecting container is provided with an overflow ending in said sewage.

17. A shower assembly according to claim 1, wherein the circulation system is provided with a temperature controlling device (45) which connects or disconnects a heating source (42) in the circulation circuit.

* * * * *